US007178431B2

(12) United States Patent
Hsien

(10) Patent No.: US 7,178,431 B2
(45) Date of Patent: Feb. 20, 2007

(54) EXTENDABLE HANDLES FOR HAND TOOLS

(76) Inventor: Chih-Ching Hsien, No. 367, Pei-Yang Rd., Feng Yuan, Taichung (TW)

( * ) Notice: Subject to any disclaimer, the term of this patent is extended or adjusted under 35 U.S.C. 154(b) by 55 days.

(21) Appl. No.: 10/910,301

(22) Filed: Aug. 4, 2004

(65) Prior Publication Data

US 2006/0027053 A1 Feb. 9, 2006

(51) Int. Cl.
*B25B 23/16* (2006.01)

(52) U.S. Cl. ..... 81/177.2; 81/427.5

(58) Field of Classification Search ..... 81/177.2, 81/427.5, 489, 177.1; 16/429, 430; 403/109.1
See application file for complete search history.

(56) References Cited

U.S. PATENT DOCUMENTS 3,189,069 A * 6/1965 Stowell ..... 81/177.1
6,761,094 B2 * 7/2004 Tobako ..... 81/177.2

* cited by examiner

*Primary Examiner*—Debra S Meislin

(57) ABSTRACT

A hand tool includes a work section and a handle section connected to the work section. The handle section has one recess defined in an outer surface thereof so as to receive a spring and a bead. An extendable portion is movably mounted to the handle section and has two dents. The extendable portion is moved relative to the hand portion by receiving the bead in one of the dents so as to have a longer arm of force when using the hand tool.

3 Claims, 6 Drawing Sheets

EXTENDABLE HANDLES FOR HAND TOOLS

FIELD OF THE INVENTION

The present invention relates to a hand tool having extendable handles which increase arm of force when output a torque.

BACKGROUND OF THE INVENTION

A conventional hand tool such as a pliers includes two handles which have a fixed length and two jaws between an object to be tightened or loosened is clamped. The user holds the handles to rotate the object. However, because the handles have fixed length, so that the arm of force is limited and in some situations, the fixed-length handles cannot complete the job. U.S. Pat. Nos. 6,176,159 and 4,090,420 disclose a pliers which has the shortcomings as mentioned above. Even if the hand tool has longer handles which occupy too much space and are not convenient to be stored and carried.

The present invention intends to provide a hand tool whose handles have an extendable portions so that the user may extend the length of the handles as needed.

SUMMARY OF THE INVENTION

The present invention relates to a hand tool which comprises a work section and a handle section connected to the work section. The handle section having at least one first positioning mechanism. An extendable portion is movably mounted to the handle section and has two second positioning mechanisms. The at least one first positioning mechanism is engaged with one of the two second positioning mechanisms when the extendable portion is positioned at a position away from the work section 10.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
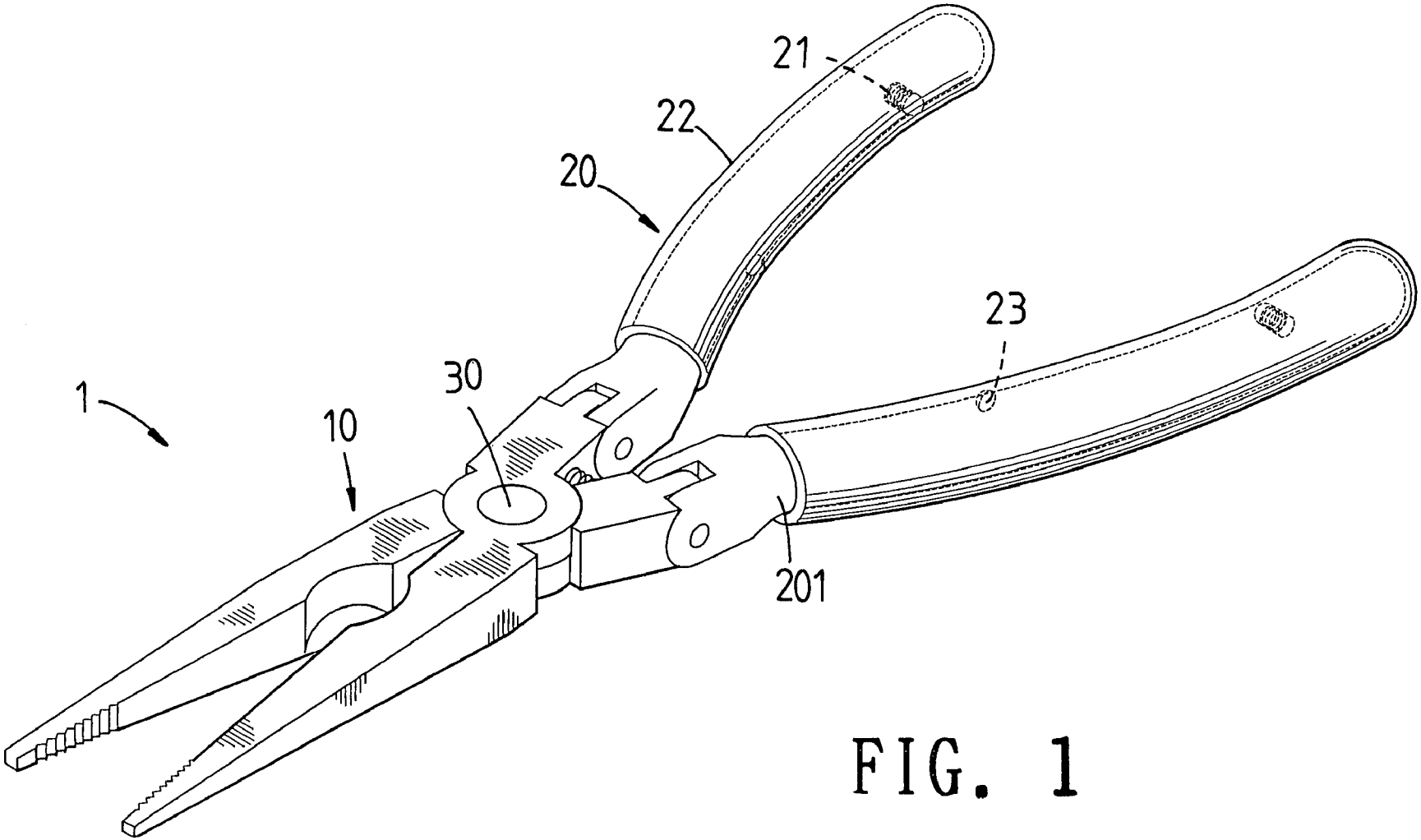
FIG. 1 is a perspective view to show the hand tool of the present invention.
Figure 2:
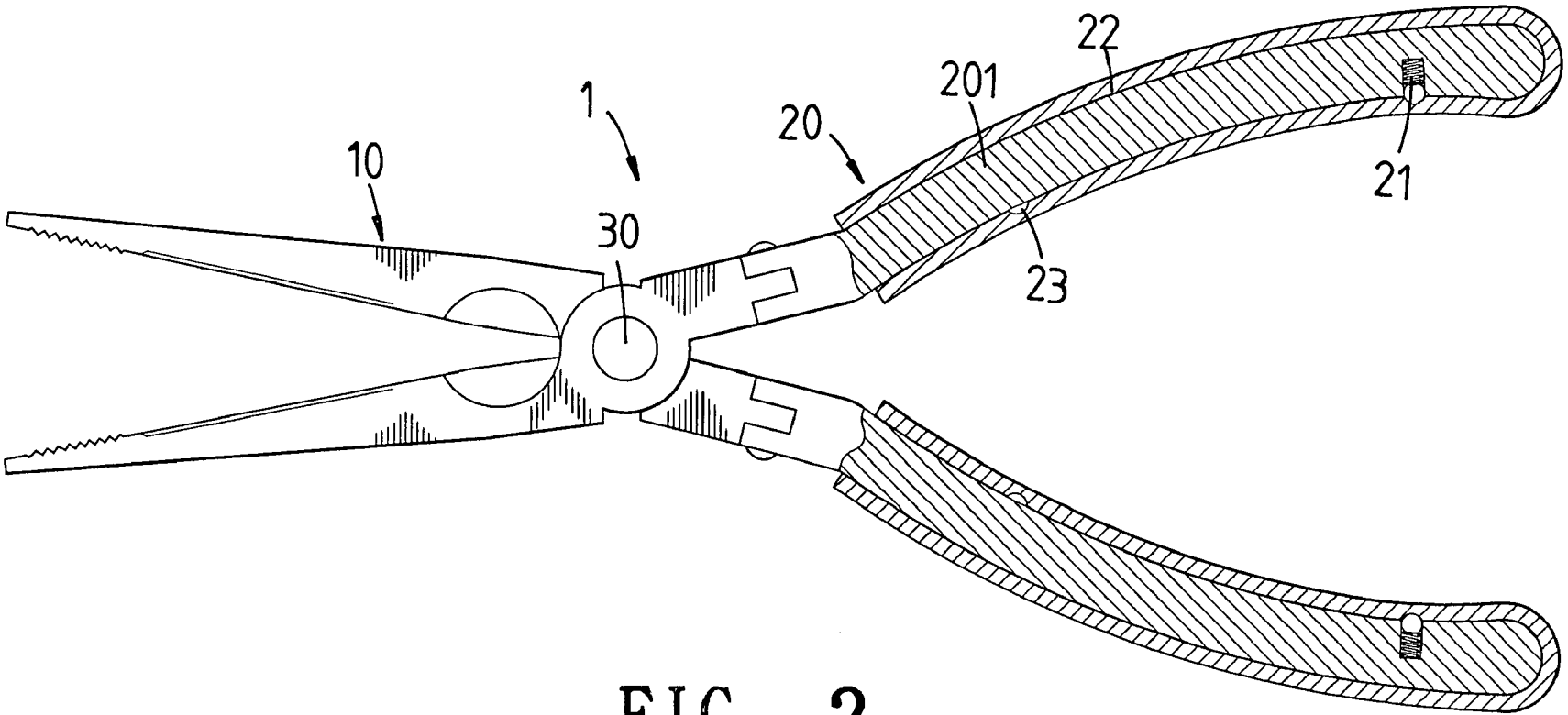
FIG. 2 is a cross sectional view to show the extendable portions mounted to the two handles of the hand tool.

Referring to FIGS. 1 and 2, the hand tool such as a pliers 1 of the present invention comprises a work section 10 which is composed of two jaws pivotably connected with each other by a pin 30 and a handle section 20 which is composed of two handles 201 respectively connected to the two jaws of the work section 10. Each of the handles 201 of the handle section 20 has a first positioning mechanism 21 which includes a recess defined in an outer surface of the handle 201 and a spring and a bead are received in the recess. Two extendable portions 22 each are a sleeve having an open end through which the handle section 20 is inserted. Each extendable portion 22 has two second positioning mechanisms 23, 24 which are two dents located at different distance from the work section 10.

Figure 3:
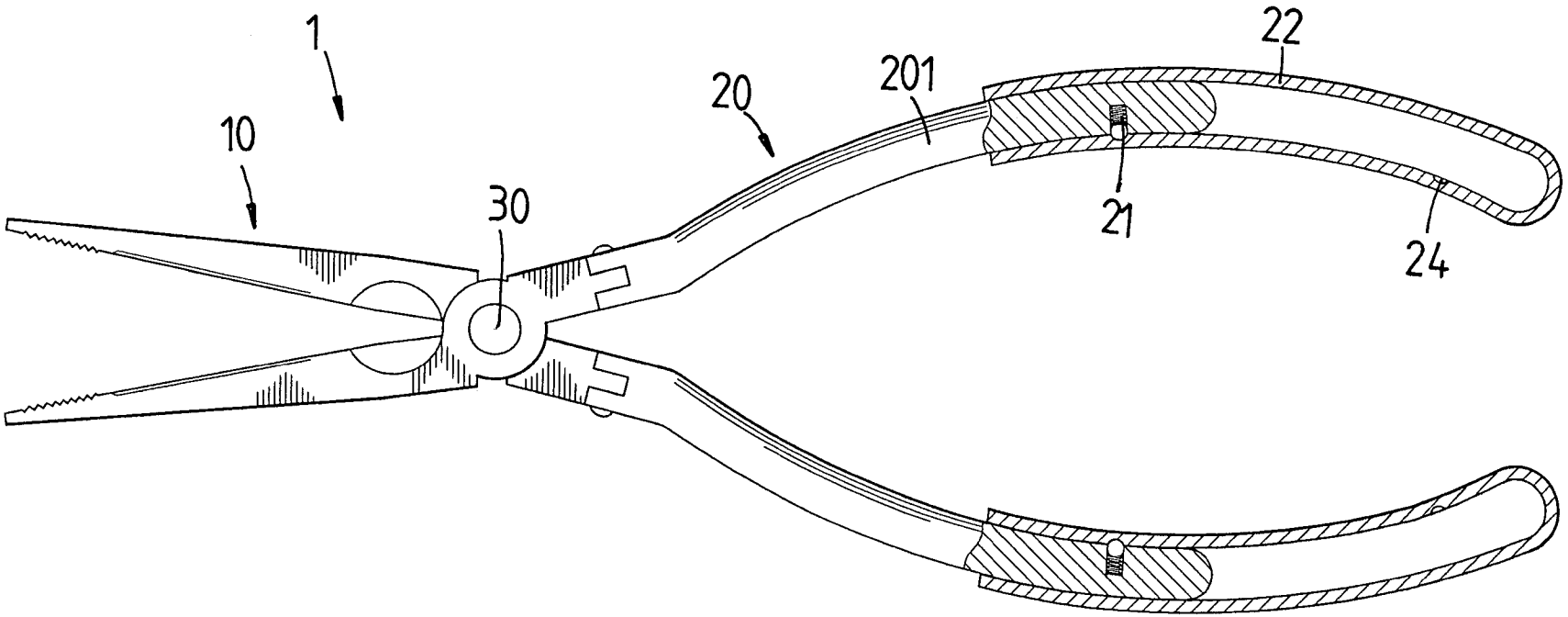
FIG. 3 shows the extendable portions are positioned at extended positions.
Figure 4:
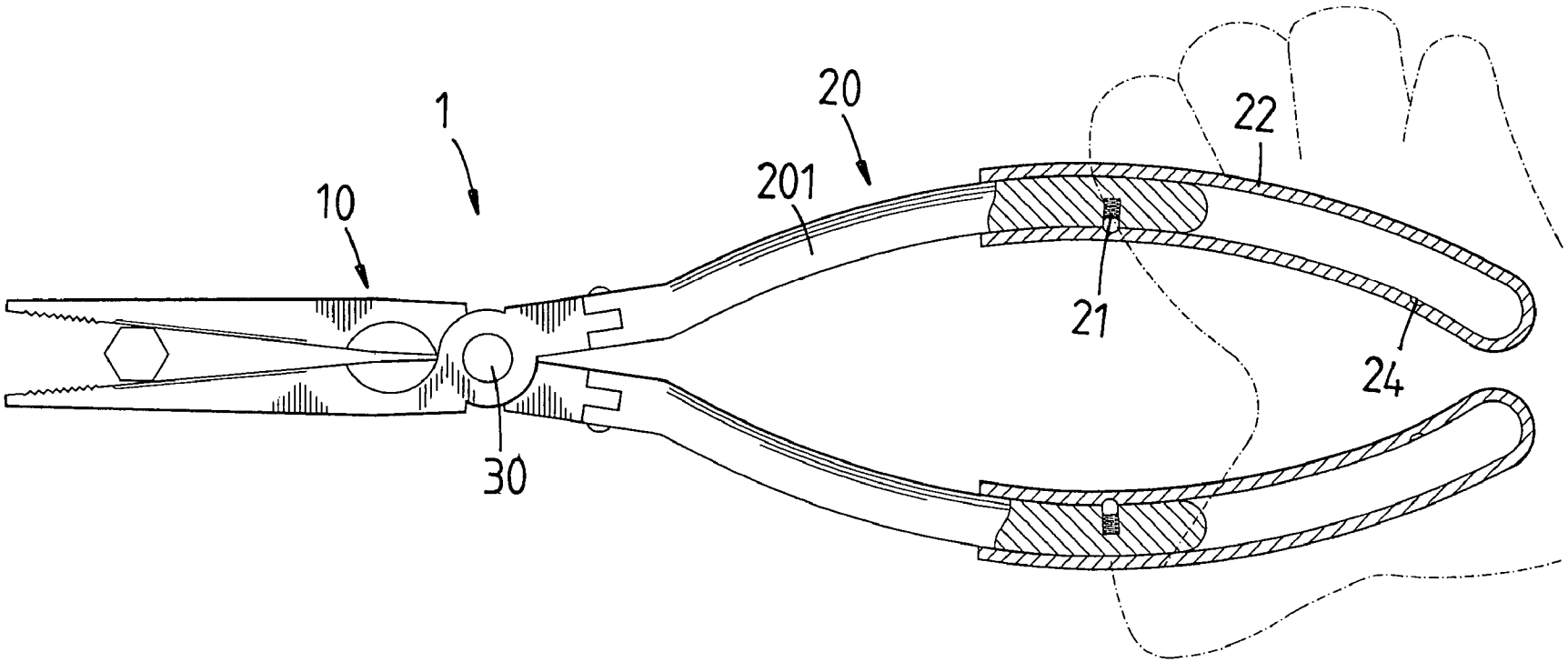
FIG. 4 shows the user's hand grasping the extendable portions.

As shown in FIGS. 3 and 4, when a longer handle section 20 is needed, the extendable portions 22 are pulled away from the work section 10 and the bead of the first positioning mechanism 21 is disengaged from the second positioning mechanism 24 and engaged with the second positioning mechanisms 23 so as to position the handle section 20. By holding the extendable portions 22, the user may rotate the hand tool.

Figure 5:
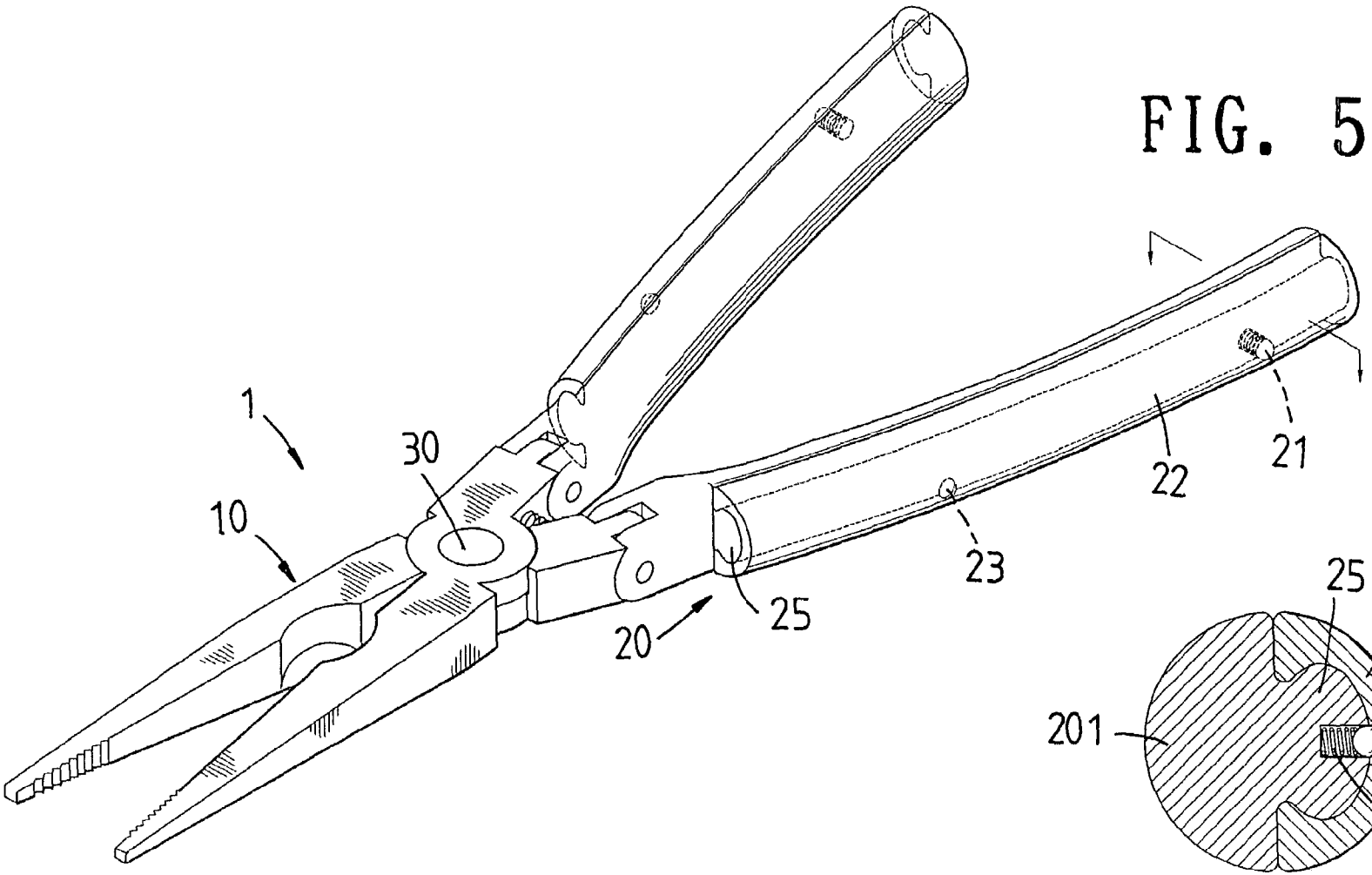
FIG. 5 is a perspective view to show another embodiment of the hand tool of the present invention.
Figure 7:
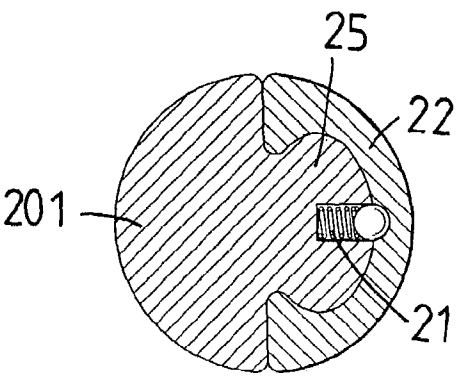
FIG. 7 is a cross sectional view to show the engagement of the extendable portion and the ridge on the handle in the embodiment in FIG. 5.
Figure 6:
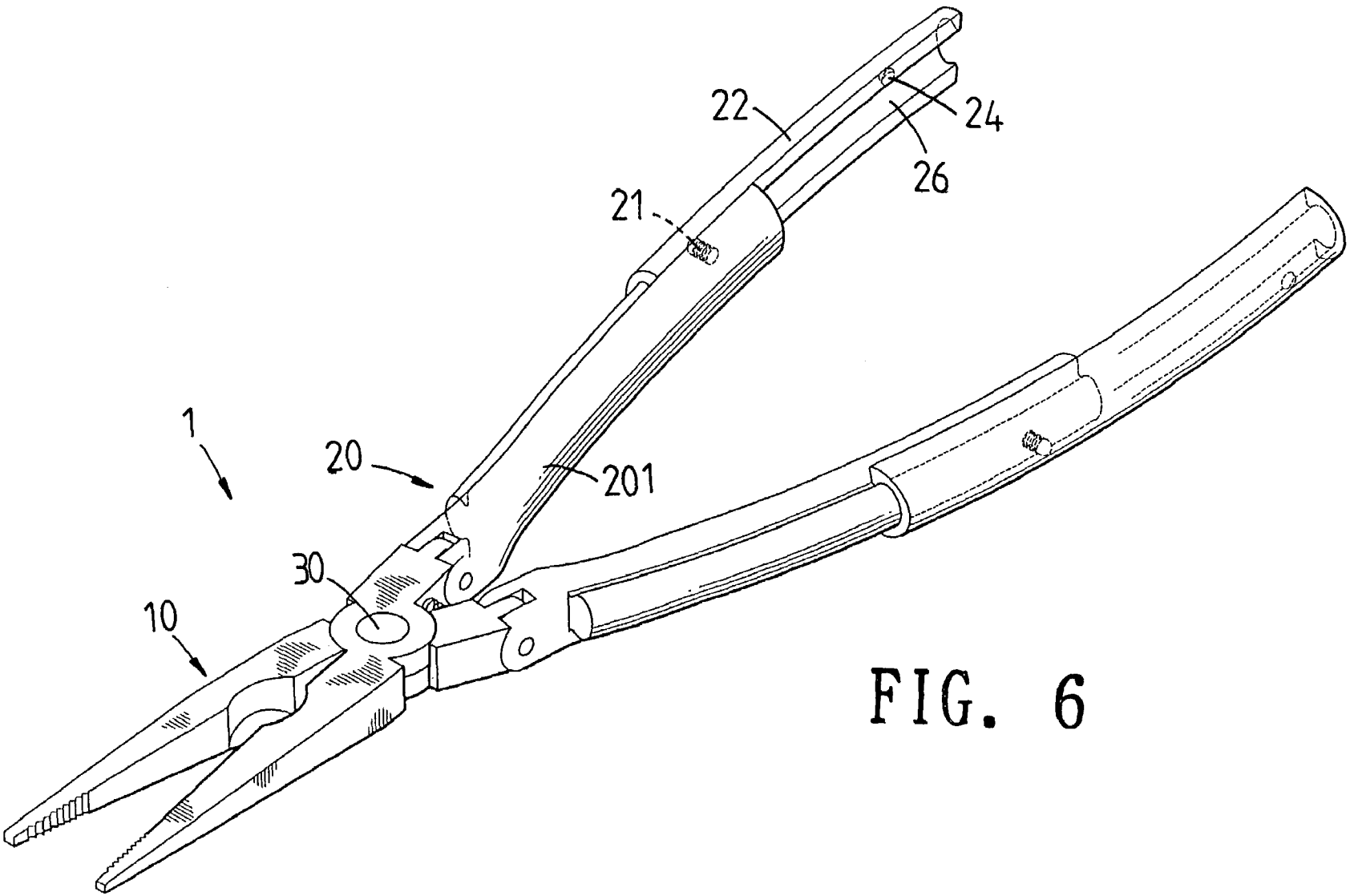
FIG. 6 shows the extendable portions of the embodiment in FIG. 5 are positioned at extendable positions.

Another embodiment of the extendable section 20 is disclosed in FIGS. 5 to 7, wherein each of the handles 201 of the handle section 20 includes a ridge 25 extending from an outer surface thereof and a cross section of the ridge 25 includes an enlarged portion and a neck which is connected to the handles 201. A first positioning mechanism 21 is connected to the ridge 25 and includes a recess defined in an outer surface of the handle 201 so as to receive a spring and a bead therein. The extendable potion 22 has an arc-shaped cross section which includes a groove 26 defined longitudinally with which the ridge 25 is engaged. Each extendable portion 22 has two second positioning mechanisms 23, 24 which are two dents located at different distance from the work section 10.

As shown in FIG. 8, when a longer handle section 20 is needed, the extendable portions 22 are pulled away from the work section 10 and the bead of the first positioning mechanism 21 is disengaged from the second positioning mechanism 24 and engaged with the second positioning mechanisms 23 so as to position the handle section 20.

While we have shown and described the embodiment in accordance with the present invention, it should be clear to those skilled in the art that further embodiments may be made without departing from the scope of the present invention.

What is claimed is:

1. A hand tool comprising:

two work sections pivotably connected with each other and two handle sections are connected to the work sections respectively, each of the two handle sections including a ridge extending from an outer surface thereof and at least one first positioning mechanism connected to the ridge, and two extendable portions movably mounted to the two handle sections respectively and each extendable portion having an arc-shaped cross section which includes a groove with which the ridge is engaged, each of the extendable portions having at least one second positioning mechanism and the at least one first positioning mechanism of the ridge corresponding thereto being engaged with the at least one second positioning mechanism when the extendable portion is positioned at a position away from the work section.

2. The hand tool as claimed in claim 1, wherein the at least one first positioning mechanism includes a recess defined in the handle section and a spring and a bead are received in the recess, the at least one second positioning mechanism being a dent which receives a part of the bead.

3. The hand tool as claimed in claim 1, wherein a cross section of each of the ridges includes an enlarged portion and a neck which is connected to the handle portion.

* * * * *